United States Patent [19]

Buzzi et al.

[11] 4,324,364

[45] Apr. 13, 1982

[54] ADJUSTABLE SHOWER HEAD

[75] Inventors: Günther Buzzi; Magdalena Faisst, both of Schiltach, Fed. Rep. of Germany

[73] Assignee: Hans Grohe GmbH & Co. KG, Fed. Rep. of Germany

[21] Appl. No.: 131,378

[22] Filed: Mar. 18, 1980

[30] Foreign Application Priority Data

Mar. 27, 1979 [DE] Fed. Rep. of Germany ..... 2911936

[51] Int. Cl.[3] ..... B05B 1/06; B05B 1/08

[52] U.S. Cl. ..... 239/383; 239/441; 239/449; 239/447; 239/460

[58] Field of Search ..... 239/383, 440, 441, 447–449, 239/456–458, 460, 102, 552, 562

[56] References Cited

U.S. PATENT DOCUMENTS 3,344,994 10/1967 Fife ..... 239/457

3,967,783 7/1976 Halsted et al. ..... 239/447

4,117,979 10/1978 Lagarelli et al. ..... 239/449

4,151,957 5/1979 Gecewicz et al. ..... 239/447

*Primary Examiner*—Robert B. Reeves

*Assistant Examiner*—Michael J. Forman

*Attorney, Agent, or Firm*—McGlew and Tuttle

[57] ABSTRACT

An adjustable shower head for producing adjustable sprays comprising, a housing, a liquid supply connection connected to the housing for the input of liquid into the housing, and a slide bushing mounted for rotation and axial movement in the housing which has an inclined slot defined thereon and a toothed rim which is engageable by a pinion which is rotatably mounted on the housing wall. The pinion carries a guide pin which is flushly engaged within the inclined slot for axial movement of the slide bushing when the pinion is rotated. At least one spray element is fixedly connected to the slide bushing for producing an adjustable output spray of liquid.

14 Claims, 6 Drawing Figures

ADJUSTABLE SHOWER HEAD

FIELD AND BACKGROUND OF THE INVENTION

The invention relates to a shower head which is adjustable for producing different sprays. The shower head has a spray ring which is axially movable in a housing and which has an outside surface with spray slots extending axially thereon. The shower head has an axially movable spray bottom which is equipped with spray holes. Above the spray bottom is a valve rotor for the generation of pulsating jets making it possible to connect the spray ring and/or spray bottom to a valve member, by the axial motion of which the incoming liquid can be directed selectively to the spray ring and/or to the spray bottom, and the spray ring and/or spray bottom being in connection with a coulisse guiding means which is manually drivable by means of a turning member mounted in the housing wall.

In one known adjustable shower head (German DE-OS No. 27 22 967) a tubular part containing both a spray bottom and a spray ring is axially movable by means of a cam plate which is rotatably mounted in the shower head tangential to the tubular part and fixed to a handle disposed outside of the housing. On its face, facing the tubular part, the cam plate is provided with a spiral groove engaged in a flush manner by a pin fastened to the tubular part. This spiral groove effects the axial motion of the tubular part when the plate is rotated by means of the handle.

The cam plate's bearing axis and axis of rotation is perpendicular to the axis of the tubular part. Although the shower head of this known design is rather long and oval in shape, the accommodation of the cam plate in the housing requires a lateral expansion which, as viewed in axial direction of the tubular part, occupies at least twice the size of the maximum stroke length. Therefore, a compact design is not possible for this kind of axial motion of the spray ring or spray bottom, and also the physical shape of the shower head housing must necessarily have a bulge where the cam plate is accommodated, which effects the physical appearance of the shower head unfavorably. Since the diameter of the cam plate must be at least twice as big as the maximum stroke and the lead of the spiral groove relative to the angle of rotation of the cam plate cannot exceed a certain maximum because of the ease of operation required on the other hand, the stroke length achievable therewith has relatively narrow limits.

In another known shower head (German DE-OS No. 26 13 618), in which a tubular part is provided as a fixed component, which is closed at its face and equipped with a spray ring. This tubular part is enclosed by a tubular housing which is axially movable relative to the tubular part so that its lower terminal edge can assume different positions relative to the spray ring. An eccentric member is seated in a radial hole of the housing and is mounted on a shaft extending radially and rotatably mounted in the tubular part. By turning the shaft with a handle disposed outside the housing, the housing can be moved axially. Here again, for construction reasons, only a relatively short housing stroke is possible, and there is no proportionality between the angle of rotation of the eccentric and the axial motion of the housing. The consequence of this is that a fine adjustment is possible only at the end postion of the axially movable housing. In the center position, a small rotary motion of the eccentric results in a relatively great axial motion, because the ratio between the angle of rotation of the eccentric and the axial motion of the housing is subject to the sine law. The force required to move the housing along the entire stroke length also changes accordingly.

SUMMARY OF THE INVENTION

It is an object of the present invention to improve a shower head of the kind described at the outset so as to make possible, by simpler means permitting a more compact design, a relatively long axial stroke of the spray ring and/or shower head bottom relative to the housing, and to make the ratio between the angle of rotation of the turning member and the corresponding axial stroke arbitrarily selectable and thus adaptable to the existing circumstances.

According to the invention, this problem is solved in that the spray ring and/or the spray bottom is connected to a slide bushing which is guided for axially movement in the hollow-cylindrical housing and whose outside surface is provided with an inclined guide slot which extends at least partly in the manner of a thread, and has a toothed rim running along it, with a pinion, which is rotatably mounted in the housing wall and provided with a guide pin projecting into the guide slot, and meshing with the toothed rim.

The principal advantage achieved with this arrangement is that the control cam, in the form of a guide slot extending in the axial direction relative to the axis of motion of the slide bushing, which is also the axis of symmetry of the shower head needs no more space than corresponds to the maximum stroke length of the spray ring and spray bottom. Also the lead of the guide slot is fixable arbitrarily in a wide angular range which may be between 0° and 70°, e.g. so that the guide slot lead is great in certain sections and small in certain other sections. In the areas where the guide slot lead is small, the axial motion is adjustable very finely, whereas a long axial travel is achievable in the great lead areas with a relatively small angular rotation of the pinion. The guide slot may be endless in itself so that a rotation of the slide bushing beyond 360° is possible in both directions. The slot may be of wave shape, in particular of sine wave shape, or it may be helical and have stops at both ends, in contact with the guide pin in the two extreme positions. Due to the threadlike, sine-shaped or helical guide slot in the outside surface of the slide bushing there results from the rotation of the pinion through the guide slot, the flanks of which support themselves on the guide pin of the pinion, not only an axial motion, but also a rotary motion of the slide bushing and of the spray ring or spray bottom connected to it about their axis of symmetry. This facilitates moving the spray ring or spray bottom because this requires much less force than a purely axial motion, and it has the additional advantage that the rotary motions of the spray ring relative to the hollow-cylindrical housing bring about a certain cleaning effect through which calcareous deposits, for instance, on the spray ring or on the housing, are dissolved.

Accordingly, an object of the present invention is to provide an adjustable shower head for producing adjustable sprays comprising, a housing, a liquid supply connection connected to the housing for the input of liquid to the housing, a slide bushing mounted for rotation and axial movement in the housing having an inclined slot defined thereon. The bushing also has a toothed rim defined thereon which is engaged by a pinion which is rotatably mounted through the housing wall. The pinion is connected to a guide pin which is guided in a flush manner within the inclined slot so that, with rotation of the pinion, the slide bushing rotates and moves axially in the housing. At least one spray element is fixedly connected to the slide bushing for producing an output spray of the liquid which is adjustable with axial movement of the slide bushing.

A further object of the present invention is to provide an adjustable shower head as set forth above wherein the spray element comprises either a spray ring which defines spray passages with the housing or a spray bottom which contains a rotatable valve rotor to produce pulsating sprays. The adjustable shower head may include both a spray ring and a spray bottom for producing both types of sprays.

A still further object of the present invention is to provide an adjustable shower head which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
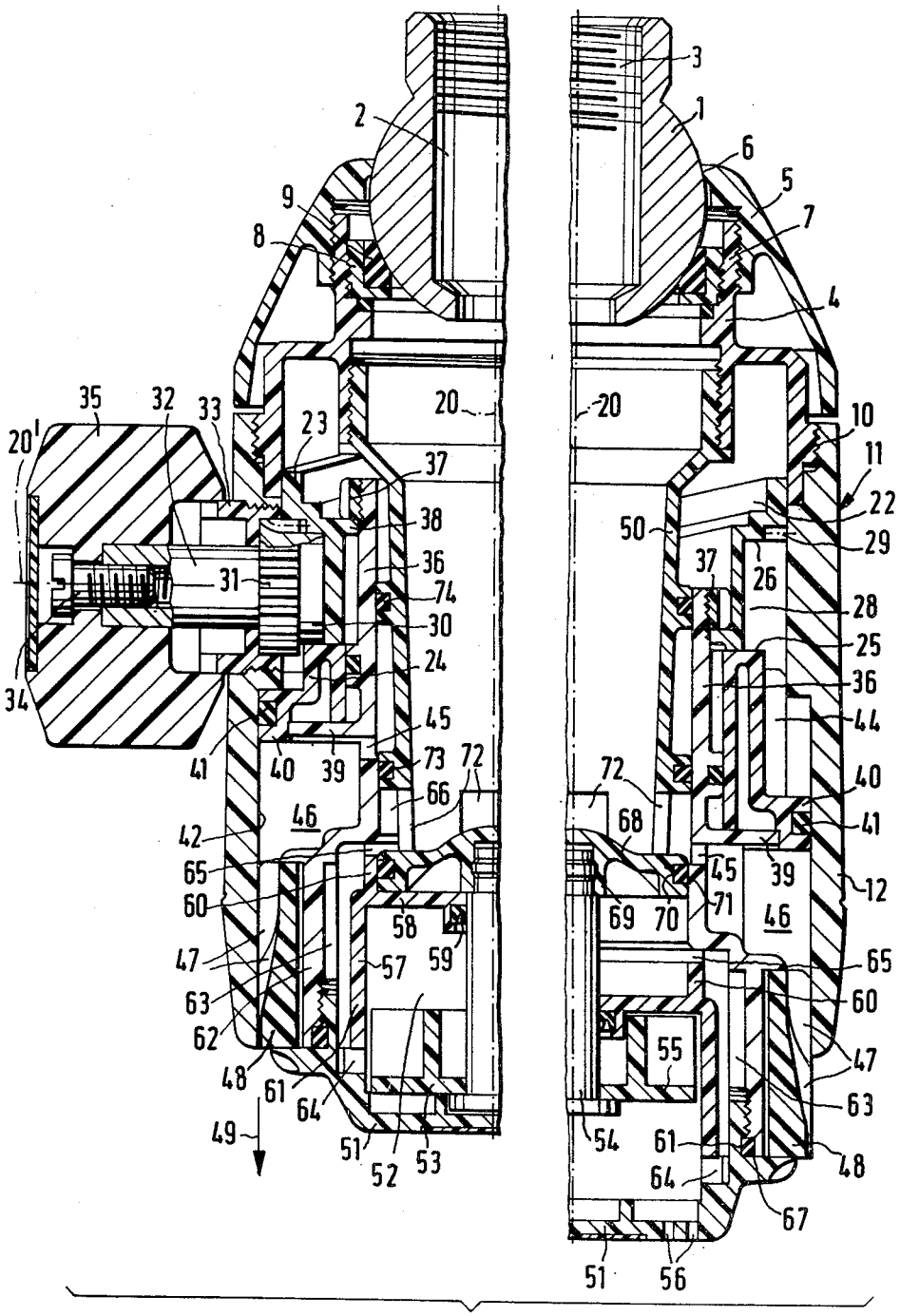
FIG. 1 is a side sectional view showing an adjustable shower head in accordance with the invention with the right hand side of the figure showing a spray element in its extreme lower position and the right hand side of the figure showing the same spray element in its extreme top position.
Figure 2:
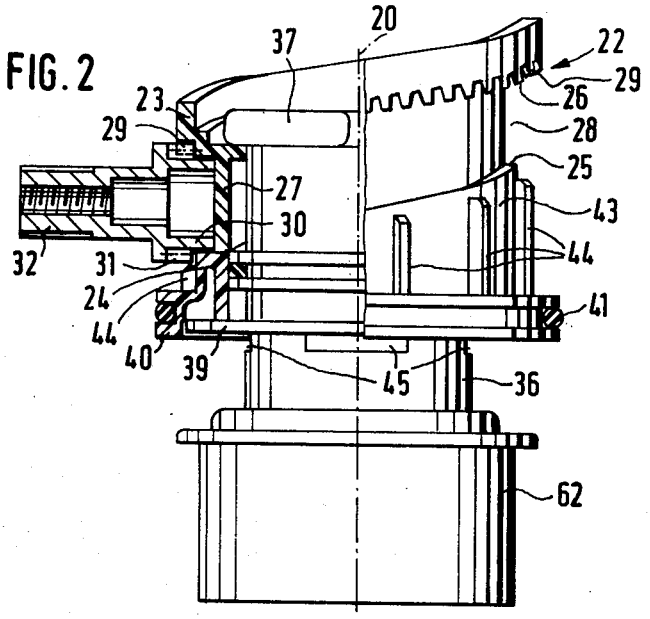
FIG. 2 is a view partially in section and partially in side elevation of a sub assembly of the shower head shown in FIG. 1.
Figure 3:
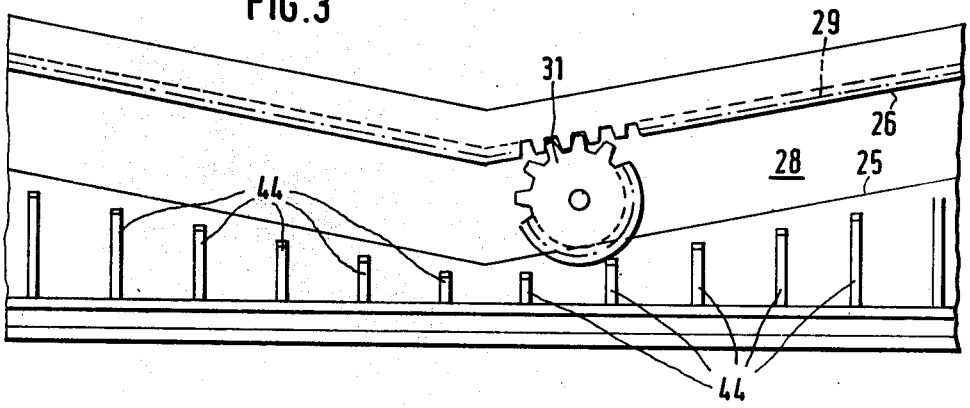
FIG. 3 is a developmental view of an outside surface of a slide bushing used in accordance with the invention.
Figure 4:
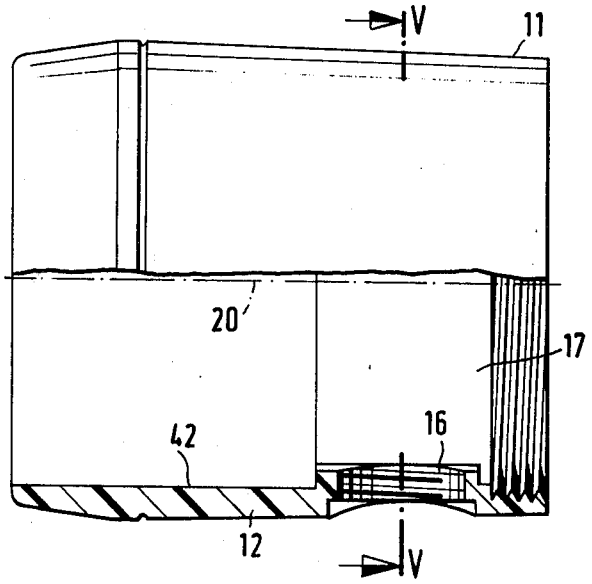
FIG. 4 is a side view partially in section and partially in elevation of a housing component for the adjustable shower head shown in FIG. 1.
Figure 5:
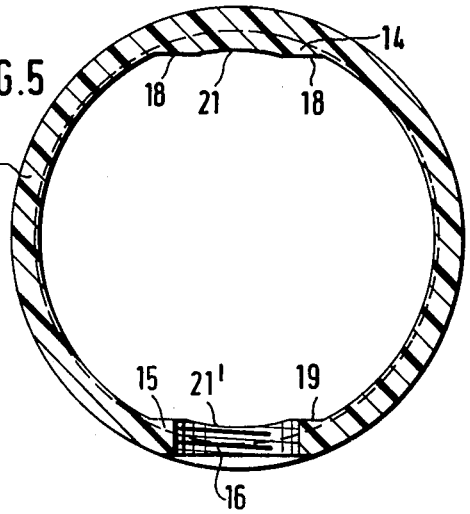
FIG. 5 is a view taken along the line 5—5 of FIG. 4.
Figure 6:
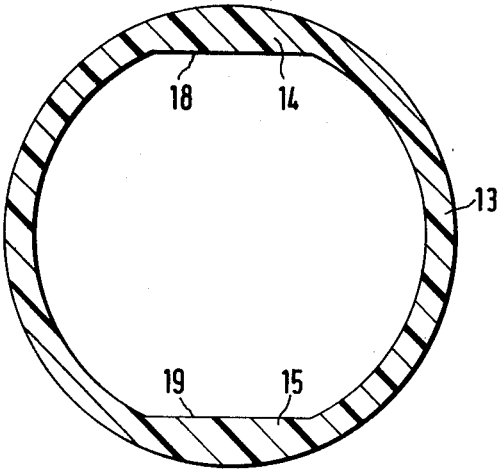
FIG. 6 is a sectional view similar to FIG. 5 of a different section of the tubular housing shown in FIG. 4.

The shower head shown in FIG. 1 comprises the head of a so called overhead shower, in contrast to a hand-held shower, which is fastened to a ball head 1 so as to be swivelable in all directions. The ball head 1 is provided with an axial bore 2 and connectable to a water pipe, e.g., of a shower stall, by means of a thread 3. The assembly by which the shower head is attached to the ball head 1 consists essentially of two parts, namely a hollow-cylindrical holder 4 and a cupshaped screw cover 5 whose bore wall 6 rests against the upper half of the ball head 1 and is screwed to a threaded collar 7 of the holder 4. Seated in the threaded collar 7 by means of a cup 8 is a sealing ring 9 which rests against the lower half of the ball head 1 with a certain preload, sealing it. A housing 11 is joined to the holder 4 by a thread 10. The housing 11 consists of metallic or plastic tubular part 12 which is mostly cylindrical and has a section as shown in FIG. 6, where the wall 13, otherwise cylindrical both inside and out, has two diametrically opposed thicker portions 14 and 15 in the form of circular segments, one of which being provided to accommodate a tapped hole 16. As may be seen from FIGS. 4 and 5, the tubular part 12 is bored out cylindrically to the right and left or above and below the tapped hole 16 to a diameter larger than corresponds to the original rough inside diameter. This forms, in the area of the hole 16, a belt 17 having partly cylindrical and partly flat inside surfaces 18 and 19. The flat inside surfaces 18 and 19, running parallel to each other and parallel to the centerline 20 of the housing part 11, also have bored out portions 21 and 21' which match the diameter or curvature of a cylindrical slide bushing 22 and partly serve to guide the slide bushing. The slide bushing 22 is composed of two parts, namely an upper part 23 and a lower part 24, their parting line running along a helical face 25, opposed by a face 26 of the upper part 23 running parallel thereto. (See FIGS. 1 and 2). The cylinder wall 27 of the upper part 23, located between the faces 25 and 26, is of a smaller outside diameter than that of the faces 25 and 26 so that the faces 25 and 26 axially limit a threadlike inclined guide slot 28. A toothed rim 29 runs along the upper face 26. Projecting into the guide slot 28 is a hollow-cylindrical guide pin 30 (FIG. 1) and a pinion 31 meshes with the toothed rim 29. The guide pin 30 and the pinion 31 are one integral component of a hollow shaft 32 which is rotatably mounted in the tapped radial hole 16 of the tubular part 12 or housing 11 by means of a threaded bushing 33, and to which a manually operable knob 35 is fixed by means of a screw 34.

The two parts 23 and 24 of the slide bushing 22 are jointly disposed on a tubular part 36 and rigidly joined to it or to each other by it. Parts 23 and 24 are joined by means of a threaded nut 37 which is seated on an annular shoulder 38 of the upper part 23 and screwed to the upper end of the tubular part 36, and by a flange 39 on which the lower part 24 of the slide bushing 22 sits. The lower part 24 of the slide bushing 22 is provided with a grooved flange 40 which accommodates an O-ring 41 supported in sealing fashion by the cylindrical inside surface 42 of the housing 11. In order to provide a power-transmitting, low-friction guidance connection in all axial positions of the slide bushing 22, however, in the area of the belt 17 of housing 11 between the housing part 12 on the one hand, in which the pinion 31 and the guide pin 30 are mounted, and in the tubular part 12 on the other hand, there are provided on the cylindrical outside surface 43 located between the face 25 and the grooved flange 40, axially extending guide ribs 44 arranged in angular intervals which are smaller than the angle corresponding to the arc length of the bored-out radii 21 and 21' (FIG. 5).

Directly below the flange 39, the tubular part 36 is provided with slot-shaped radial ports 45 which connect the cylindrical cavity of the tubular part 36 to an annular canal 46 which communicates with the spray slots 47 of a spray ring 48. The spray ring 48 is rigidly joined to the lower portion of the tubular part 36, and its outside surface is in sealing contact with the inside surface 41 of housing 11. In the axial direction, the spray slots 47 are of conical shape of triangular section which becomes smaller in the downward direction, i.e. in the discharge direction shown by arrow 49, so that thick and relatively soft jets are generated in the lowest position of the spray ring 48, which is shown in the right half of FIG. 1, whereas toward the uppermost position, shown in the left half of FIG. 1, the spray ring 48 generates thin and sharp jets.

The tubular part 36 is rotatably mounted on a guide tube 50 so as to be movable axially and about its own axis which coincides with the centerline 20 of the housing 11. Tubular part 36 is additionally provided with a spray bottom 51. Located above the spray bottom 51 is a turbine chamber 52 which contains a valve rotor 53 which is rotatably mounted on a pin and whose bottom 55, provided with a segment cutout, alternately covers or closes the spray holes 56 of bottom 51 when it rotates.

The turbine chamber 52 is formed by the cylindrical cavity of a canshaped hollow part 57 whose upper face wall 58 is provided with a sealing ring 59 resting in sealing fashion against the cylindrical pin 54 and having a cylindrical collar 60 on its top side. Between the cylinder wall 61 of the hollow part 57 and a cylindrical wall 62 of the tubular part 36, is an annular canal 63 which communicates with ducts of the spray bottom 51 ending obliquely radially in the turbine chamber 52 on the one hand, and through an annular opening 65 with the cylindrical cavity 66 of the tubular part 36 on the other. The spray bottom 51 is screwed into the face of the wall 62 of the tubular part 36 and sealed by means of an annular seal 67.

The guide tube 50, with its upper end screwed into the holder 4, has, at its lower end, a closed bottom 68. The hub 69 of bottom 68 has the pin 54 fastened thereto. An outer annular groove 70 of bottom 68 seats an O-ring 71 which rests in sealing fashion either against the cylindrical inside surface of the tubular part 36 or else of the collar 60, when the collar is raised to its uppermost position. Directly above the bottom 68, the guide tube 50 has several radial port holes 72 which, depending on the axial position of the tubular part 36, communicates either with the annular canal 46 through the ports 45 or with the annular canal 63 through the annular opening 65. Disposed above the port holes 72 on the outside surface of the guide tube 50 is an annular seal 73 resting in sealing fashion against the inside surface of the tubular part 36. A second annular seal 74, likewise resting against the inside surface of the tubular part 36, is fastened to the guide tube 50 at a certain axial distance from the other annual seal 73.

It may be seen from FIG. 1 that the tubular part 36 together with the slide bushing 22, the spray ring 48 and the spray bottom 51, is movable axially relative to the housing 11 and the guide tube 50 rigidly joined thereto, between the upper position shown in the left half of FIG. 1 and the lower position shown in the right half of FIG. 1. Any desired intermediate positions is possible. All that is required to move the tubular part 36 or the spray ring 48 and the spray bottom 51 is to turn the knob 35 in the one or the other direction about its axis 20' which extends radial to the centerline 20. By turning the knob 35 and the pinion 31 fixed thereto, both the slide bushing 22 and the tubular part 36 are also turned about the centerline 20 so that, due to the motion of the guide slot 28 relative to the guide pin 30 brought by the threadlike lead of the guide slot 28 or its faces 25 and 26, an axial motion of the slide bushing 22 and of the tubular part 36 with the spray ring 48 and the spray bottom 51 relative to the housing 11 or to the port holes 72 of the guide tube 50, results. As long as the sealing ring 71 of the bottom 68 of the slide tube 50 is in the collar 60 of the can 57 forming the turbine chamber 52 and the turbine chamber 52 communicates via the ducts 64, the annular canal 63 and the annular opening 65 with the port holes 72, pulsating jets are being generated, which discharge from the spray holes 56 of the spray bottom 51. The pulsation originates due to the rotary motion of the valve rotor 53 which is rotated by the liquid entering the turbine chamber 52 obliquely radially through the ducts 64, thereby alternately opening and closing the spray holes 56 in the spray bottom 51.

As soon and as long as the sealing ring 71 is above the annular opening and the port holes 45 of the tubular part 36 are below the sealing ring 73, nonpulsating liquid jets are generated which discharge through the spray slots 47 of the spray ring 48 and can be of different thickness and sharpness or hardness, depending on the set discharge section of the spray slots 47. The rings 71 and 73 thus act as valve means with the ports 45 and 65.

Due to the invented design and operating mode of the arrangement for the axial motion of the spring ring 48 and spray bottom 51 it is possible to achieve, with compactness, a long axial stroke, particularly of the spray ring 48 and, hence, a relatively great variability of the spray characteristic generated by the spray ring. In another form of the invention the ring 48 or the bottom 51 can be provided above and can be termed spray elements.

Due to the fact that, as described, both the annular canal 46 and the turbine chamber are each defined at their faces by surfaces whose respective parts 39, 40, 48,62 and 51,58 are each spaced from each other firmly, i.e. invariably, it is assured that the axial liquid pressure prevailing in these chambers is equalized and can have no braking effect on the axial shifting drive.

The use of the tube section shown in FIG. 6 and described above as raw material for the housing 11 brings with it a considerable material cost saving and less labor than would the use of a tube whose wall thickness corresponds to the wall thickenings 14 and 15.

While specific embodiments of the invention have been shown and described in detail to illustrate the application of the principles of the invention, it will be understood that the invention may be embodied otherwise without departing from such principles.

What is claimed is:

1. An adjustable shower head for producing adjustable sprays comprising:

a housing having a major axis and at least one inner cylindrical guide surface;

a liquid supply connection connected to said housing for the input of liquid to said housing;

a slide bushing mounted for rotation on said inner cylindrical guide surface and for axial movement in said housing along said major axis, said slide bushing having an inclined slot defined on an outer cylindrical surface thereof, said slide bushing having a toothed rim thereon extending along a portion of said slot;

a stub shaft rotatably mounted on said housing extending radially of said housing and carrying a pinion engaged with said toothed rim for rotation of said slide bushing with rotation of said pinion;

a handle member connected to said stub shaft and extending out of said housing for rotation of said pinion;

a guide pin coaxially connected to said pinion and guided in a flushed fashion in said inclined slot for axial movement of said bushing with rotation of said pinion; and at least one spray element fixed to said slide bushing for movement thereof and to define a variable nozzle opening with at least a portion of said housing to produce an output spray of the liquid which is adjustable with axial movement of said slide bushing in said housing which movement varies said variable nozzle opening, and flow path means connected between the liquid supply connection and said variable nozzle opening.

2. An adjustable shower head according to claim 1, wherein said spray element comprises a spray ring connected to said slide bushing adjacent one end of said housing defining with said one end of said housing longitudinally extending nozzles having a decreasing cross-section in the output direction of the spray.

3. An adjustable shower head according to claim 1, wherein said spray element comprises a spray bottom member connected to a lower end of said slide bushing adjacent one end of said housing, a valve rotor rotatably mounted in said spray bottom member said spray bottom member including at least one spray hole over which said valve rotor moves to produce a pulsating spray of the liquid, said spray bottom member defining at least one spray port for receiving liquid from said liquid connection and directing it obliquely against said valve rotor to rotate said valve rotor and produce the pulsating spray.

4. An adjustable shower head according to claim 3, further including a spray ring connected to said slide bushing disposed radially outwardly of said spray bottom member and defining with said one end of said housing, a plurality of axially extending spray nozzles having cross-sectional areas decreasing in the direction of output spray.

5. An adjustable shower head according to claim 4, further including a hollow cylindrical tubular part connected to said spray bottom member and said spray ring which includes at least one radially extending port disposed between said inclined slot and said spray ring, said hollow cylindrical tubular part defining an annular canal with said housing communicating with said at least one radially extending port, and a guide tube fixedly connected to said housing and extending into said hollow cylindrical tubular port having at least one opening, said liquid connection connected into an interior of said guide tube for supplying liquid through said opening and through said radially extending port into said canal, said canal communicating with said nozzles.

6. An adjustable shower head according to claim 5, further including at least one seal connected to said guide tube and engaged with said hollow cylindrical tubular part for closing communication between said opening of said guide tube and said radially extending port of said hollow cylindrical tubular part when said slide bushing is in an uppermost position of its axial movement, said spray bottom member defining a turbine chamber communicating with said opening with said slide bushing in said uppermost position.

7. An adjustable shower head according to claim 6, wherein said guide tube includes a bottom member for closing off a bottom of an interior of said guide tube.

8. An adjustable shower head according to claim 7 including at least one additional seal extending outwardly from said bottom member of said guide tube engaged with an interior of said hollow cylindrical tubular part at a position below said radially extending port of said hollow cylindrical tubular part for blocking communication between said opening of said guide tube and said turbine chamber when said slide bushing is in a lowered position.

9. An adjustable shower head according to claim 1, wherein said inclined slot is closed on itself.

10. An adjustable shower head according to claim 1, wherein said inclined slot is helical, said slide bushing having a stop at each end of said helical inclined slot.

11. An adjustable shower head according to claim 10, wherein said wave-shaped slot is sinusoidal in shape.

12. An adjustable shower head according to claim 1, wherein said inclined slot is wave-shaped.

13. An adjustable shower head according to claim 1, wherein said slide bushing comprises two separate portions divided along one face of said inclined slot.

14. An adjustable shower head according to claim 1, wherein said housing comprises a substantially cylindrical tubular part including, on an inside surface thereof, in the vicinity of said guide pin, two diametrically opposed wall thickenings which each have an arc shaped central section shaped and of a diameter to receive said slide bushing, said tubular part having large diameter portions above and below the vicinity of said guide slot defining a belt area.

* * * * *